US009032775B2

(12) United States Patent
Gupta

(10) Patent No.: US 9,032,775 B2
(45) Date of Patent: May 19, 2015

(54) MANDREL FOR WRAPPING OF CABOCHONS

(71) Applicant: Nikhil Gupta, Schaumburg, IL (US)

(72) Inventor: Nikhil Gupta, Schaumburg, IL (US)

( * ) Notice: Subject to any disclaimer, the term of this patent is extended or adjusted under 35 U.S.C. 154(b) by 0 days.

(21) Appl. No.: 14/157,760

(22) Filed: Jan. 17, 2014

(65) Prior Publication Data

US 2014/0202579 A1 Jul. 24, 2014

Related U.S. Application Data

(60) Provisional application No. 61/754,363, filed on Jan. 18, 2013, provisional application No. 61/768,696, filed on Feb. 25, 2013.

(51) Int. Cl.

| | |
|---|---|
| ***B21D 31/00*** | (2006.01) |
| ***A44C 27/00*** | (2006.01) |
| ***B21F 3/04*** | (2006.01) |
| ***B21J 19/04*** | (2006.01) |
| ***B21F 1/06*** | (2006.01) |
| *B21F 1/00* | (2006.01) |

(52) U.S. Cl.

CPC ..... *A44C 27/00* (2013.01); *B21F 1/002* (2013.01); *B21F 3/04* (2013.01); *B21J 19/04* (2013.01); *B21F 1/06* (2013.01)

(58) Field of Classification Search

CPC ..... B21J 19/04; B21F 1/002; B21F 1/06; B21F 3/04; A44C 27/00

USPC ..... 140/105, 106; 81/487; 29/160.6; 269/287

See application file for complete search history.

(56) References Cited

U.S. PATENT DOCUMENTS

| | | | | | |
|---|---|---|---|---|---|
| 1,264,519 | A | * | 4/1918 | Hinsey | 72/477 |
| 3,172,452 | A | * | 3/1965 | Bryant | 72/388 |
| 4,051,974 | A | * | 10/1977 | Gentile | 215/329 |
| 4,522,055 | A | * | 6/1985 | Berger | 72/477 |
| 4,559,859 | A | * | 12/1985 | Pilczuk | 84/394 |
| D398,822 | S | * | 9/1998 | Webb | D8/14 |
| 6,446,484 | B1 | * | 9/2002 | Anderson et al. | 72/477 |
| 7,644,601 | B2 | * | 1/2010 | Brochheuser et al. | 72/283 |

* cited by examiner

*Primary Examiner* — David B Jones
(74) *Attorney, Agent, or Firm* — Robert S. Alexander

(57) ABSTRACT

A mandrel is provided with a plurality of oval sections of varying circumference formed thereabout. The circumference of a first oval section is between about 1.75" and about 2.6". The circumference of a second oval section is about 0.2" to 0.9" greater than the circumference of the first section. The circumference of a third oval section is about 0.2" to 0.9" greater than the circumference of the second section.

15 Claims, 3 Drawing Sheets

SECTION A-A
SECTION B-B
A
B
30
36A
36B
36C
36D
36E
36F
[254.51]
10.02
[14.86]
0.58
[17.93]
0.71
[22.01]
0.87
[25.07]
0.99
[30.14]
1.19
[19.80]
0.78
[19.76]
0.78
[24.36]
0.96
[30.24]
1.19
[35.08]
1.38
[39.93]
1.57
[34.73]
1.37

Wrap three lengths of wire with three separate pieces of wire spaced evenly as shown Wrap the three wire bezel around the mandrel Use chain nose pliers to bend the three wire bezel ends upward as shown Form a bail Insert the Stone
and
Secure it by Making Zig Zags

MANDREL FOR WRAPPING OF CABOCHONS

CLAIM FOR PRIORITY

This non-provisional application claims the benefit of the filing date of U.S. Provisional Patent Application Ser. No. 61/754,363, of the same title, filed Jan. 18, 2013 and Ser. No. 61/768,696, of the same title, filed Feb. 25, 2013. The priority of U.S. Provisional Patent Application Ser. No. 61/754,363 and Ser. No. 61/768,696 are hereby claimed and the disclosures thereof are incorporated into this application by reference.

Many hobbyists have taken up beading as a past time, making decorative jewelry and ornamental objects for their families and friends as well as themselves. One particular ornament that is quite popular with beaders are referred to as cabochons which resemble gemstones and are usually generally convex polished semiprecious stones or simulacra thereof, possibly flattened on one side. In beader's parlance, the term is also sometimes broadened beyond strict adherence to jeweler's terminology and used to describe faceted stones as well. In a typical application, the cabochon is often drilled, adhered to a setting or wire-wrapped to incorporate it into a larger piece. However, drilling of a cabochon can be problematic leaving an un-aesthetic hole to be concealed, while adhering it to a setting presupposes a setting of the correct size and shape for the cabochon. As cabochons come in a very wide variety of sizes and shapes, it can be appreciated that even the largest retailers might have difficulty stocking settings that would be appropriate for each cabochon that a beader might wish to mount. Accordingly, beaders quite commonly will wire wrap cabochons as this forms an attractive, durable and retentive setting that does not damage the cabochon but rather forms a retentive cage that can be adapted to an extremely wide variety of sizes and shapes. This invention relates to a mandrel having 6 sections formed therein wherein beaders may form wire wraps suitable for the vast majority of commercially available cabochons by forming a preformed circumferential band of at least 3 wires around one of the sections, the circumferential band comprising one centrally located circumferential wire and two retention wires arrayed on either side of the central wire, placing the cabochon in the band, then deforming the retention wires inwardly to form a retention cage which will grasp the cabochon within the cage allowing it to be mounted or suspended as desired by the beader as well as a method of forming retention cages for cabochons using that mandrel.

This invention thus provides a mandrel for pre-forming wire to be wrapped around a cabochon, facilitating formation of an attractive durable and retentive wire wrap for the cabochon so that it may be easily attached to a necklace, bracelet, ear-ring or an item of clothing either as a pendant or as an appliqué.

BRIEF DESCRIPTION OF THE DRAWINGS

The invention is described in detail below with reference to the various Figures, wherein.

DESCRIPTION OF THE PREFERRED EMBODIMENT

The invention is described in detail below with reference to several embodiments. Such discussion is for purposes of illustration only. Modifications to examples within the spirit and scope of the present invention, set forth in the appended claims, will be readily apparent to one of skill in the art. Terminology used throughout the specification and claims herein is given its ordinary meaning.

In manufacture of wire wrapped cabochons, it has surprisingly been found that despite the wide number and variety of cabochons currently offered in the beading and homemade jewelry trade, it is possible to conveniently form wrappings accommodating the vast majority of such cabochons currently offered a plurality of mandrels as described in figures hereof. In particular, I have found that most if not almost all of the currently offered cabochons can be wrapped using the sizes indicated in the figures and table 1 below.

Figures 1, 3, 3A, 5, 7, 9, 11, 12:
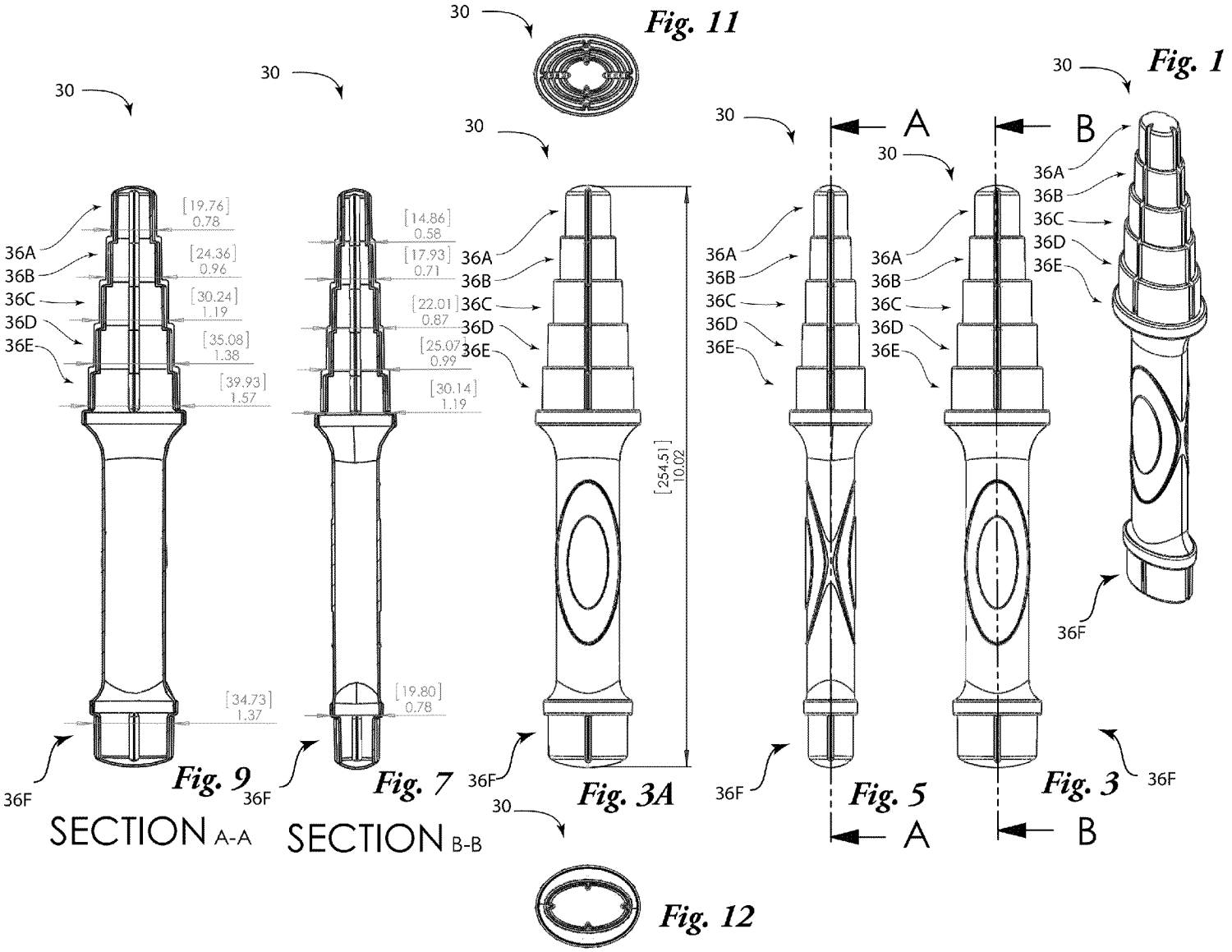
FIG. 1 is a schematic isometric perspective illustrating an assembled mandrel of the present invention.
FIGS. 3 and 4 are, respectively, frontal elevations and exploded frontal elevations of the mandrel of the present invention.
FIGS. 3A and 4A are versions of FIG. 3 and with section marks deleted for clarity.
FIGS. 5 and 6 are, respectively, side elevations and exploded side elevations of the mandrel of the present invention
FIGS. 7 and 8 are sectional views of section B-B illustrated in FIGS. 3 and 4 respectively.
FIGS. 9 and 10 are sectional views of section A-A illustrated in FIGS. 5 and 6 respectively.
FIGS. 11 and 12 are respectively a top plan and gripping bottom plan view of the mandrel of the present invention.
Figures 2, 4, 4A, 6, 8, 10:
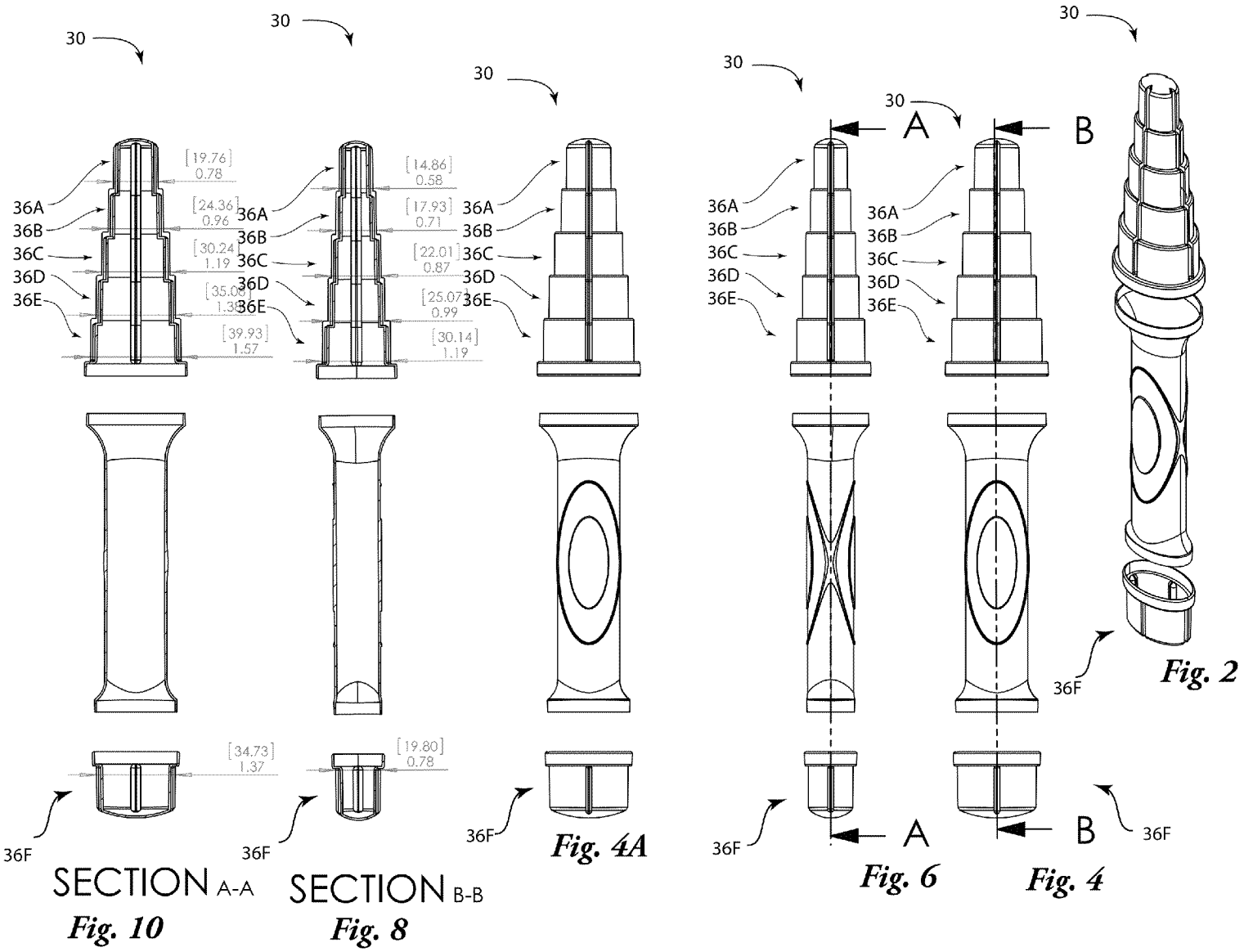
FIG. 2 is an exploded isometric perspective illustrating one embodiment of the mandrel of the present invention as three separate mouldings making up the assembled mandrel.
Figure 13:
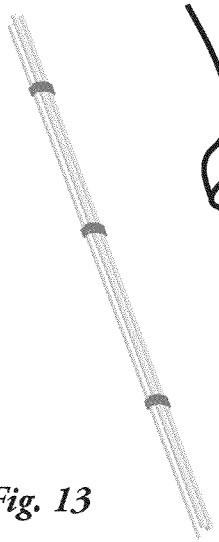
FIGS. 13-17 illustrate use of the mandrel of the present invention with FIG. 17 also illustrating an assembled pendant formed by the method of the present invention.
Figure 14:
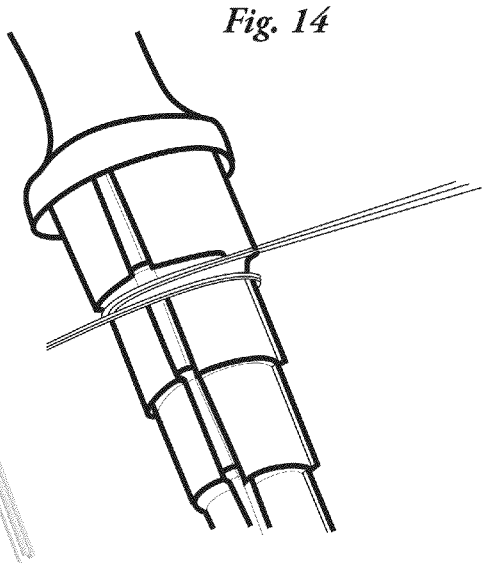
Figure 15:
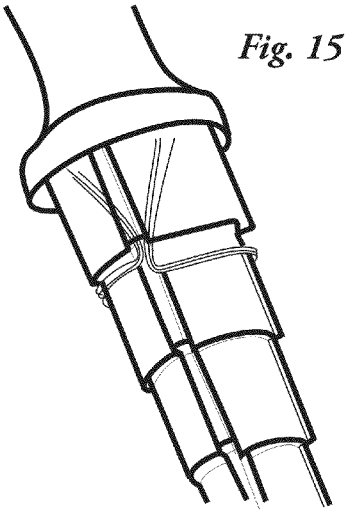
Figure 16:
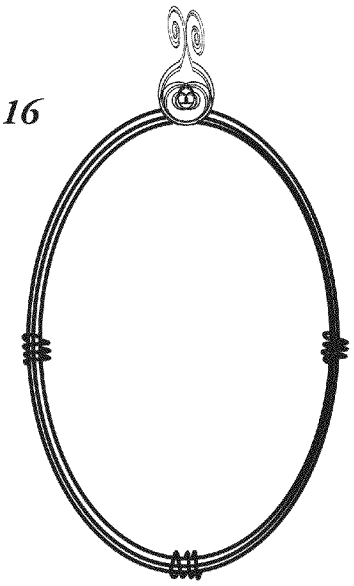
Figure 17:
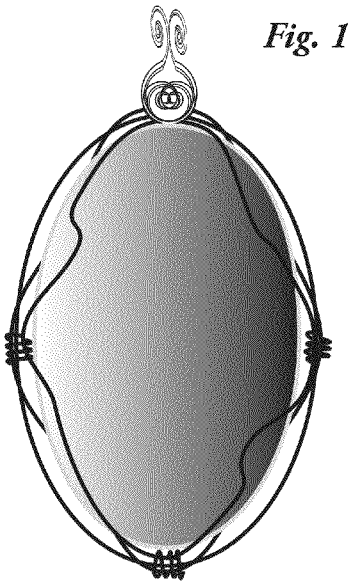

In FIG. 1, mandrel 30 has central gripping portion 32 adjacent forming section 34 having forming cylinders 36A, 36B, 36C, 36D, and 36E located thereabove as well as forming cylinder 36F formed therebelow. Each forming cylinder takes the approximate shape of an elliptical cylinder having major and minor diameters as indicated on the drawing and as prescribed in table 1 below.

TABLE 1

| Section # | Most Preferred circumference, inches | Suitable range, inches | Preferred | Most Preferred diameters | Ratio of diameters | e |
|---|---|---|---|---|---|---|
| 1 | 2.16 | 1.75-2.6 | 2-2.5 | 0.78" × 0.58" | 1.34 | 0.67 |
| 2 | 2.65 | C1 + (0.2-0.9) | C1 + (0.25-0.75) | 0.96" × 0.71" | 1.35 | 0.67 |
| 3 | 3.27 | C2 + (0.2-0.9) | C2 + (0.25-0.75) | 1.19" × 0.87" | 1.37 | 0.68 |
| 4 | 3.77 | C3 + (0.2-0.9) | C3 + (0.25-0.75) | 1.38" × 0.99" | 1.39 | 0.70 |

TABLE 1-continued

| Section # | Most Preferred circumference, inches | Suitable range, inches | Preferred | Most Preferred diameters | Ratio of diameters | e |
|---|---|---|---|---|---|---|
| 5 | 4.37 | C4 + (0.2-0.9) | C4 + (0.25-0.75) | 1.57" × 1.19" | 1.32 | 0.65 |
| 6 | 3.50 | C3 + (0.1-0.6) | C3 + (0.15-0.5) | 1.37" × 0.78" | 1.75 | 0.82 |

Note:
C1 refers to Section #1 and C2-C4 refer to the respectively numbered Section.
"e" refers to eccentricity.

In forming a wire wrapping for cabochon, the approximate circumference of the cabochon is first determined and lengths of wire exceeding that circumference by a length which is sufficient to form a bail for the cabochon. Typically, at least three lengths of wire will be used although it is possible to form a wire wrapping with only two. In many cases, four or more lengths of wire will be used. To conveniently form a cage or wire wrapping, these selected circumferential lengths are wrapped with much shorter joining lengths of wire then these circumferential lengths of wire are wrapped around the section of the mandrel having dimensions most closely matching the circumference of the cabochon with the joining lengths of wire each being disposed in a retention groove 38 formed into each forming cylinder. Typically, each retention groove has a depth of between 0.03" and 0.15" and a width of between 0.03" and 0.25" and serves to hold the joining lengths of wire in place as the cabochon cage is wrapped. After a preform cage has been formed, a bail (if desired) is formed at the ends of the circumferential wrapping wires, the preform wrapping is removed from the mandrel, and the cabochon is placed within the preform cage and the upper and lower most circumferential wires are reformed inwardly to trap the cabochon within the cage securely.

Preferably, the ratio of diameters of the elliptically cylindrical forming surfaces will be between about 1.2:1 to about 2.0:1 or the eccentricity of elliptical surfaces will vary between about 0.55 and about 0.9. More preferably, the ratio of diameters will be between about 1.3:1 and 1.8:1 or the eccentricity will be between about 0.6 and 0.85. It is preferred that the circumference of each succeeding forming cylinder will exceed that of next smaller forming cylinder by between about 0.2 and 0.9 inches, more preferably between about 0.35 to about 0.75 inches, even more preferably between about 0.4 inches and about 0.7 inches and most preferably between about 0.45 and 0.55 inches. In this way a graduated array of forming cylinders can be formed which will closely approximate the circumference of most cabochons. The most preferred major and minor diameters for the forming cylinders are set forth in Table 1. The most preferred eccentricities will range between about 0.65 and 0.75.

Wire suitable for wrapping cabochons is well known and is offered in a great many establishments and in a great many forms. In many cases it will be preferred that the wrapping wire has at least one flattened surface although full circular wire can be used. Similarly square wire, flat wire and a variety of other forms can be used. Memory wire, dead soft, half-hard wire and full-hard wire can be used although semi-soft wire is preferred. Similarly, wire of widely varied compositions can be used including sterling silver wire, stainless steel wire, gold filled wire, sterling silver filled wire, color coated wire, niobium wire, copper wire, aluminum, brass or bronze wire. The most common size of wire used ranges between 16 and 24 gauge.

While the invention has been described in detail, modifications within the spirit and scope of the invention will be readily apparent to those of skill in the art. In view of the foregoing discussion, relevant knowledge in the art and references discussed above in connection with the Background and Detailed Description, the disclosures of which are all incorporated herein by reference, further description is deemed unnecessary. In addition, it should be understood that aspects of the invention and portions of various embodiments may be combined or interchanged either in whole or in part. Furthermore, those of ordinary skill in the art will appreciate that the foregoing description is by way of example only, and is not intended to limit the invention.

What is claimed is:

1. A mandrel having a plurality of oval sections of varying circumference formed thereabout wherein the circumference of a first oval section is between about 1.75" and about 2.6" and a second oval section having a circumference about 0.2" to 0.9" greater than the circumference of the first section and a third oval section having a circumference about 0.2" to 0.9" greater than the circumference of the second section.

2. The mandrel of claim 1 further comprising a fourth oval section having a circumference about 0.2" to 0.9" greater than the circumference of the third section.

3. The mandrel of claim 1 further comprising a fourth oval section having a circumference about 0.2" to 0.9" greater than the circumference of the third section and a fifth oval section having a circumference about 0.2" to 0.9" greater than the circumference of the fourth oval section.

4. The mandrel of claim 3 further comprising a sixth oval section having a circumference about 0.1" to 0.6" greater than the circumference of the third section.

5. The mandrel of claim 1 wherein at least one of said oval sections approximates an elliptical cylinder.

6. The mandrel of claim 1 wherein at least one of said oval sections approximates an elliptical cylinder having an eccentricity of between 0.5 and 0.9.

7. The mandrel of claim 1 wherein said mandrel is formed of a polymeric material by injection moulding.

8. The mandrel of claim 1 wherein said mandrel comprises a central grippable section and a forming zone having a plurality of oval forming sections formed thereupon.

9. The mandrel of claim 1 wherein said mandrel is formed from at least two injection moulded components, one of said components comprising a central grippable handle and a second component comprising a forming zone, each of said components being formed of a polymeric material by injection moulding.

10. The mandrel of claim 9 further comprising a third injection moulded component spaced apart from said forming zone.

11. The mandrel of claim 1 wherein said oval sections are located in a forming zone and said sections each comprise an oval section approximating an elliptical cylinder having an eccentricity of between 0.55 and 0.95.

12. The mandrel of claim 1 wherein at least one of said forming sections has a plurality of locating grooves formed therein.

13. The mandrel of claim 12 wherein each groove has a depth of between 0.03" and 0.15".

14. The mandrel of claim 12 wherein each groove has a width of between 0.03" and 0.25".

15. The mandrel of claim 1 wherein at least three locating grooves are formed in at least one of said forming sections.

* * * * *